US005651689A

United States Patent [19]

Plyler et al.

[11] Patent Number: 5,651,689

[45] Date of Patent: Jul. 29, 1997

[54] ELECTRICAL CONNECTOR ASSEMBLY EMPLOYING A CONNECTOR POSITION ASSURANCE DEVICE

[75] Inventors: Robert G. Plyler, Vienna, Ohio; Terry A. Rice, Canton, Mich.

[73] Assignee: United Technologies Automotive, Inc., Dearborn, Mich.

[21] Appl. No.: 446,955

[22] Filed: May 15, 1995

[51] Int. Cl.[6] ..... H01R 13/627

[52] U.S. Cl. ..... 439/352; 439/357

[58] Field of Search ..... 439/350–355, 439/356–358, 345

[56] References Cited

U.S. PATENT DOCUMENTS

| | | | |
|---|---|---|---|
| 3,482,207 | 12/1969 | Cairns | 439/851 |
| 3,487,355 | 12/1969 | Cairns | 439/686 |
| 3,601,760 | 8/1971 | Cairns | 439/595 |
| 3,937,545 | 2/1976 | Cairns et al. | 439/272 |
| 4,159,160 | 6/1979 | Plyler et al. | 439/872 |
| 4,238,140 | 12/1980 | Cairns et al. | 439/595 |
| 4,273,403 | 6/1981 | Cairns | 439/345 |
| 4,311,355 | 1/1982 | Plyler et al. | 439/274 |
| 4,433,888 | 2/1984 | Winger | 439/357 |
| 4,531,808 | 7/1985 | Cairns et al. | 439/830 |
| 4,717,359 | 1/1988 | Rahrig et al. | 439/595 |
| 4,946,395 | 8/1990 | Cope et al. | 439/357 |
| 4,946,404 | 8/1990 | Takenouchi et al. | 439/357 |
| 4,963,103 | 10/1990 | Fink et al. | 439/358 |
| 5,120,255 | 6/1992 | Kouda et al. | 439/489 |
| 5,350,311 | 9/1994 | Roy et al. | 439/273 |

OTHER PUBLICATIONS

1973 Car Shop Manual, vol. III Electrical, Ford Marketing Corporation, pp. 32–40–02—32–40–03, 33–70–03—33–70–08, 34–01–01—34–01–13, (Sep. 1972).

*Primary Examiner*—Hien Vu

*Attorney, Agent, or Firm*—Harness, Dickey & Pierce, P.L.C.

[57] ABSTRACT

An electrical connector assembly employs a connector position assurance device to detect and interlockably secure complete mating of a pair of electrical connectors. In one aspect of the present invention, the connector position assurance device has a yoke which traps a cantilevered beam to a locking member. In another aspect of the present invention, a connector position assurance device has a yoke and a flexible arm. In yet another aspect of the present invention, a method of mating, installing and disengaging a pair of electrical connectors and a connection position assurance device is provided.

16 Claims, 3 Drawing Sheets

ELECTRICAL CONNECTOR ASSEMBLY EMPLOYING A CONNECTOR POSITION ASSURANCE DEVICE

BACKGROUND OF THE INVENTION

This invention relates generally to electrical connectors for automotive vehicles and specifically to an electrical connector assembly employing a connector position assurance device.

Recently, the demand for electrical features within automotive vehicles has greatly expanded. Such electrical features include motorized mirrors, motorized windows, motorized seat adjusters, motorized trunk lid pull down latches, navigational CRT displays, compact disc players and the like. This increase in electrical devices has necessitated more wire harness branches and the related electrical connectors.

Most traditional electrical connectors employ a stationary locking tab or rib on one mating half while the other mating half has a flexible arm with a locking or receiving slot. The arm flexes over the tab upon mating of the two connector halves and then the tab snaps into the slot thereby locking the connector halves together. Examples of such locking structures can be found within the following U.S. Pat. No. 5,350,311 entitled "Seal for an Automotive Electrical Connector Assembly" which issued to Roy et al. on Sep. 27, 1994; U.S. Pat. No. 5,120,255 entitled "Complete Locking Confirming Device For Confirming the Complete Locking of an Electric Connector" which issued to Kouda et al. on Jun. 9, 1992; U.S. Pat. No. 4,273,403 entitled "Locking Structure For Electrical Connectors" which issued to Cairns on Jun. 16, 1981; U.S. Pat. No. 4,238,140 entitled "Terminal Block with Electrical Connection Means with Connector Location Wall and Locking Fingers" which issued to Cairns et al. on Dec. 9, 1980; U.S. Pat. No. 3,937,545 entitled "Waterproof Electrical Connector" which issued to Cairns et al. on Feb. 10, 1976; and, U.S. Pat. No. 3,601,760 entitled "Electrical Connector" which issued to Cairns on Aug. 24, 1971. The disclosures of the aforementioned patents are incorporated by reference herewithin. A problem often encountered with these conventional locking constructions is that the connectors may not be fully inserted together. In other words, male and female electrical terminals contained within each connector will not provide complete and reliable electrical continuity therebetween. This situation commonly leads to intermittent electrical failures which are extremely annoying to customers and often difficult to trace during service.

In response to the incomplete mating problem, a variety of locking detection devices have been employed. One such construction consists of a pair of mating electrical connectors each having an upstanding tab or rib with a transversely oriented passageway therethrough. When these connectors are completely inserted together; the passageways within the tabs will align such that an operator can then insert a plastic pin therethrough. This pin is often made from a bright colored polymeric material for visual confirmation. In some cases an end of the pin has a barb thereon for retention when inserted through the passageways. In another construction, a pin-like member is slidably mounted in a transversely orientation for engagement with an aperture of the opposite mating connector when fully aligned. This transversely sliding pin hangs beyond the transverse edge of the electrical connector prior to complete installation. Both of these traditional constructions have proven problematic during assembly along a quickly moving vehicle assembly line.

Furthermore, they are often difficult to align and package in the tight spaces such electrical connectors are often employed.

SUMMARY OF THE INVENTION

In accordance with the present invention, the preferred embodiment of an electrical connector assembly employs a connector position assurance device to detect and interlockably secure complete mating of a pair of electrical connectors. In one aspect of the present invention, the connector position assurance device has a yoke which traps a cantilevered beam to a locking member. In another aspect of the present invention, a connector position assurance device has a yoke and a flexible arm. A further aspect of the present invention provides a pair of cantilevered beams on an electrical connector which abut against a locking formation on an opposite mating electrical connector thereby allowing full engagement of the connector position assurance device. In yet another aspect of the present invention, a method of mating, installing and disengaging a pair of electrical connectors and a connection position assurance device is provided.

The electrical connector assembly of the present invention is advantageous over conventional constructions in a variety of manners. For example, the present invention electrical connector assembly prevents inadvertent disassembly and disengagement of the electrical connectors when the connector position assurance device is fully installed. The present invention connector position assurance device can also be securely retained to a corresponding electrical connector prior to mating of both electrical connectors. Furthermore, the present invention connector position assurance device is easily packaged and inserted. The present invention is advantageous over traditional devices in that movement of the connector position assurance device toward a fully installed position serves to encourage mating engagement of the two electrical connectors. Additional advantages and features of the present invention will become apparent from the following description and appended claims, taken in conjunction with the accompanying drawings.

DETAILED DESCRIPTION OF THE PREFERRED EMBODIMENT

Figures 1, 2:
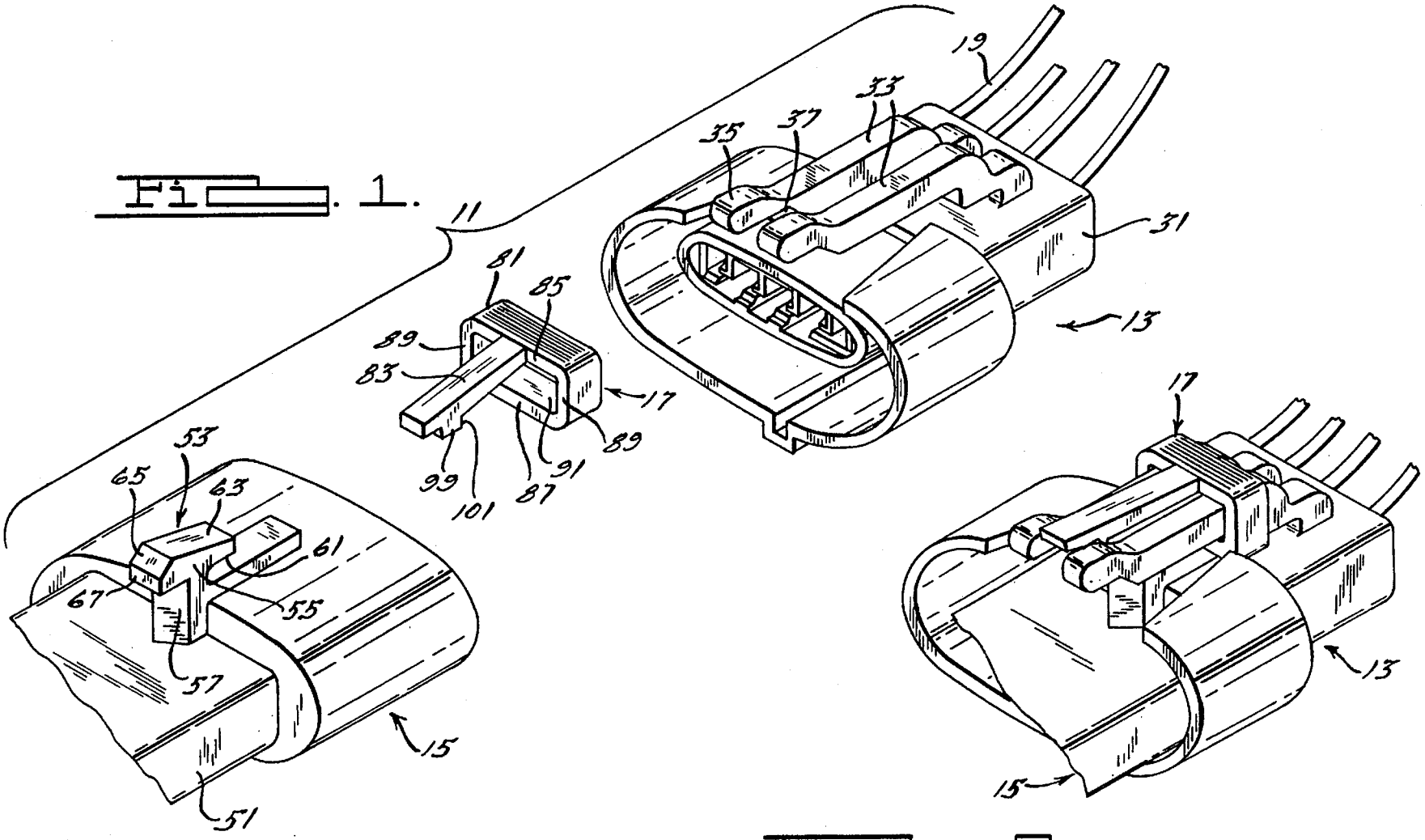
FIG. 1 is an exploded perspective view showing the preferred embodiment of an electrical connector assembly of the present invention.
FIG. 2 is a perspective view showing the preferred embodiment of the present invention electrical connector assembly of FIG. 1 but in a fully installed position.
Figure 3:
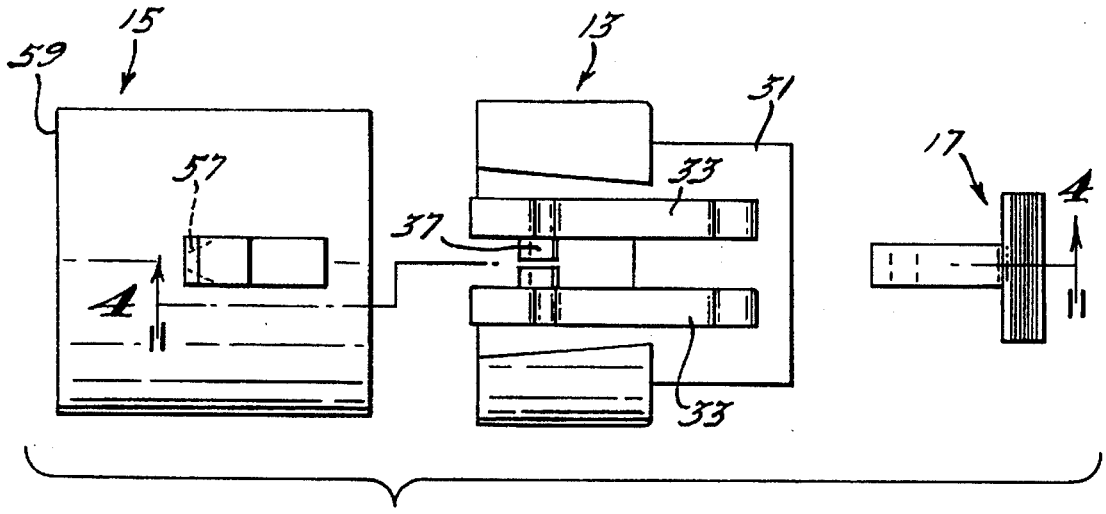
FIG. 3 is an exploded top elevational view showing the preferred embodiment of the present invention electrical connector assembly of FIG. 1.

Referring to FIGS. 1–4, the preferred embodiment of an electrical connector assembly 11 of the present invention is comprised of a first electrical connector 13, a second electrical connector 15 and a connector position assurance device 17. First electrical connector 13 is shown as a female electrical connector while second electrical connector 15 is shown as a male electrical connector. Each electrical connector 13 and 15 has a plurality of male and female conductive stamped terminals (not shown) crimped onto discretely insulated wires 19. These electrical connectors are preferably used to connect electrical wire harnesses within automotive vehicles. Electrical connectors 13 and 15, and connector position assurance device 17 are injection molded from a substantially non-conductive, high heat, engineering grade polymeric material, such as VALOX 420 which can be purchased from GE Plastics.

First electrical connector 13 has a body 31 with a pair of cantilevered beams 33 flexibly attached thereto. Cantilevered beams 33 are oriented substantially parallel to each other and to a longitudinal axis. The longitudinal axis is defined as being coincidental with the direction of mating between the electrical connectors. Each cantilevered beam 33 has an enlarged distal end 35 and an abutting formation 37 positioned adjacent thereto. Abutting formation 37 is defined by a leading chamfer 39 and a trailing abutting surface 41. Cantilevered beams 33 are flexible both away from body 31 and transversely away from each other.

Second electrical connector 15 includes a body 51 and a locking member 53. Locking member 53 is defined by an upper segment 55 and a V-shaped wedge 57 pointing toward a trailing end 59 of second electrical connector 15. Upper segment 55 of locking member 53 is also separated from body 51 by a leading undercut 61. Upper segment 55 is further defined by a leading ramp 63, a trailing ramp 65 and a trailing locking surface 67.

Connector position assurance device 17 is constructed with a yoke 81 and a flexible arm 83. Yoke 81 has an upper wall 85 and a lower wall 87 which are connected in an unbroken manner by a pair of side walls 89. A passageway 91 longitudinally projects through yoke 81. An abutting member 99 projects downwardly from arm 83 close to a distal end thereof. Abutting member 99 has an abutting surface 101.

Figure 4:
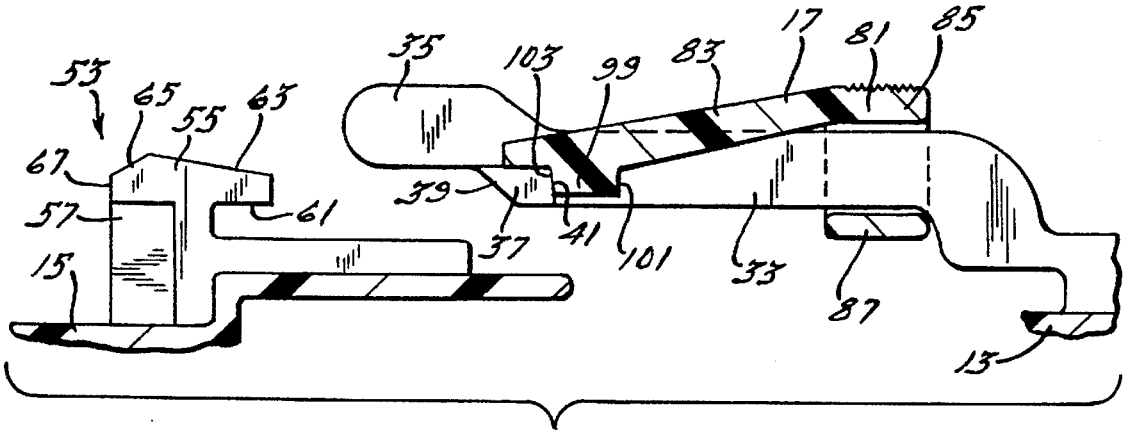
FIGS. 4–8 are sectional views, taken along line 4—4 of FIG. 3, showing the sequential steps employed to mate and install, then disengage the preferred embodiment electrical connector assembly of the present invention.

The mating, installation and disengaging operations for the present invention electrical connector assembly will be described in greater detail as follows. FIG. 4 illustrates electrical connectors 13 and 15 in a disengaged and unmated position. Connector position assurance device 17 is preassembled onto first electrical connector 13 such that yoke 81 can longitudinally slide along cantilevered beams 33. However, connector position assurance device 17 is prevented from inadvertently falling off of first electrical connector 13 through a leading edge 103 of abutting member 99 abutting against trailing abutting surface 41 of each cantilevered beam 33. Cantilevered beams 33 are shown in their free and unflexed positions.

Figure 5:
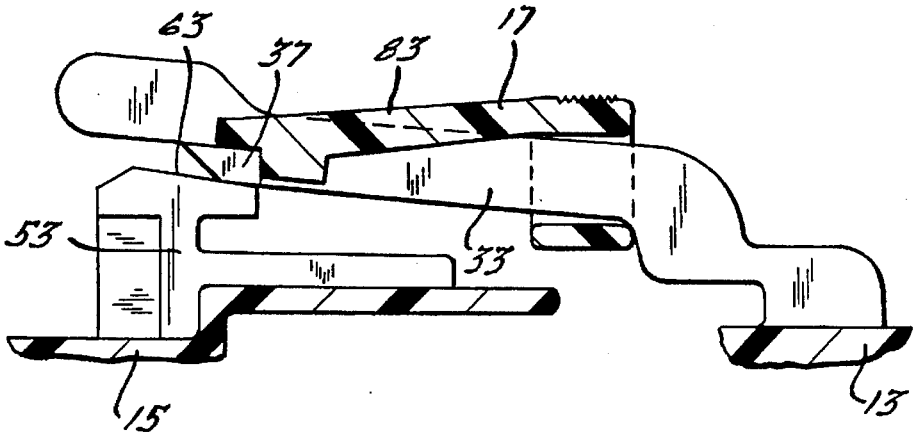

Referring to FIG. 5, second electrical connector 15 is shown partially inserted into first electrical connector 13 such that abutting formation 37 of each cantilevered beam 33 rides up leading ramp 63 of locking member 53. Arm 83 of connector position assurance device 17 flexes in response thereto. Moreover, connector position assurance device 17 assists in engaging abutting formation 37 of each cantilevered beam 33 with locking member 53 through installation and pushing of connector position assurance device 17 in the longitudinal direction thereby assisting in electrical connector mating.

Figure 6:
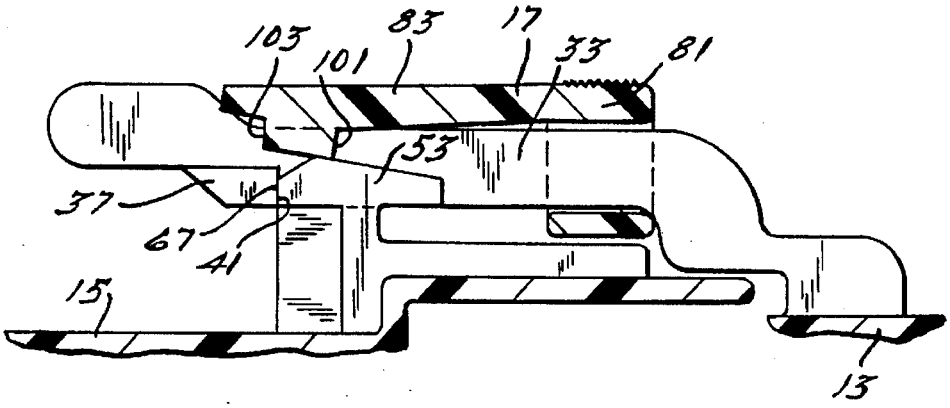

FIG. 6 illustrates second electrical connector 15 fully inserted within first electrical connector 13 such that abutting formation 37 of each cantilevered beam 33 is allowed to entirely step over locking member 53. Accordingly, trailing abutting surface 41 of each cantilevered beam 33 engages and abuts against trailing locking surface 76 of locking member 53. FIG. 6 further shows connector position assurance device 17 partially pushed forward such that the angled leading edge 103 rides over abutting formation 37.

Figure 7:
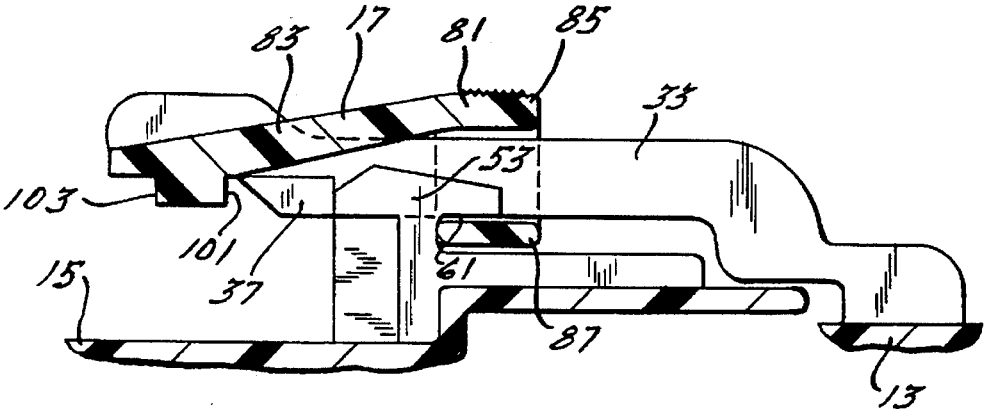

Referring now to FIG. 7, connector position assurance device 17 is shown in its fully installed position such that abutting surface 101 of arm 83 engages a leading corner of chamfer 39 of each cantilevered beam 33. Furthermore, lower wall 87 engages undercut 61 of locking member 53 such that upper and lower walls, respectively 85 and 87, of yoke 81 trap the adjacent portions of cantilevered beams 33 and locking member 53 therebetween. Thus, connector position assurance device prevents unintended and inadvertent disengagement of electrical connectors 13 and 15. This reduces the risk of intermittent electrical failures and the like. The connector position assurance device further provides a visual signal that the electrical connectors are fully engaged and mated.

Figure 8:
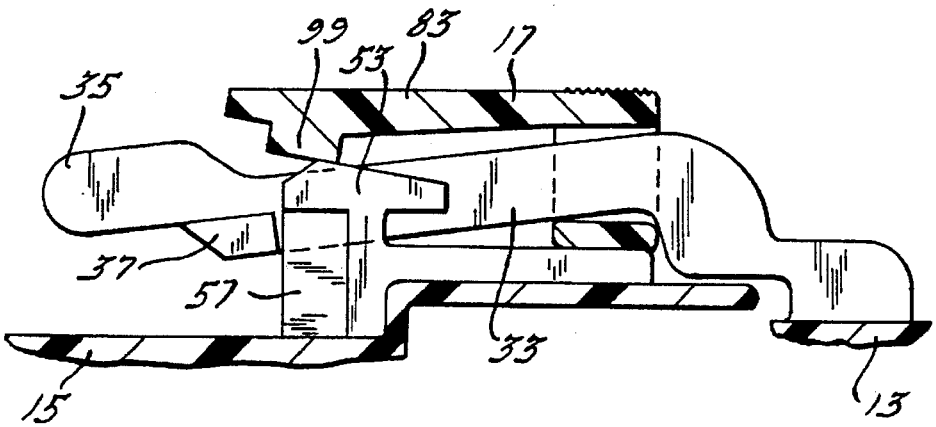

Disengagement and unmating of electrical connectors 13 and 15 can be observed in FIG. 8. First, arm 83 of connector position assurance device 17 is upwardly flexed such that abutting member 99 rides over locking member 53 while yoke 81 is rearwardly pushed. Distal end 35 of each cantilevered beam 33 is then downwardly flexed toward the body of second electrical connector 15 while first electrical connector 13 is longitudinally pulled away from second electrical connector 15. Concurrently therewith, wedge 57 of locking member 53 acts to transversely separate abutting formations 37 and the adjacent cantilevered beams 33 whereby cantilevered beams 33 are disengaged from locking formation 53. This provides for easy, quick and tool free disassembly of the electrical connector assembly, yet ensuring that this disassembly can only occur when intended.

While the preferred embodiment of this electrical connector assembly employing a connector position assurance device has been disclosed, it will be appreciated that various modifications may be made without departing from the present invention. For example, the connector position assurance device and cantilevered beams may be positioned on the male electrical connector. They can also be used in conjunction with one or more electrical junction boxes or other electrical devices that require interlocking attachment. The specific configuration of the electrical terminals and wires can also be varied as is known to one skilled in the art. It is also envisioned that a connector position assurance device having only a yoke may also be employed with an undercut locking member. Furthermore, a sideways tipped, U-shaped yoke may be transversely installed to interlock the mating electrical connectors. The locking member and one or more cantilevered beams may have alternate shapes so long as the connector position assurance device of the present invention can function appropriately. Various materials and operational steps has been disclosed in an exemplary fashion, however, other materials and operational steps may be employed. It is intended by the following claims to cover these and any other departures from the disclosed embodiment which fall within the true spirit of this invention.

The invention claimed is:

1. An apparatus comprising:

a connector position assurance device having a yoke with at least four walls and an arm longitudinally extending from said yoke, an abutting member projecting from a surface of said arm, said yoke having a longitudinally oriented passageway therethrough, said at least four walls of said yoke defining an unbroken shape surrounding said passageway;

a first electrical connector; and at least one cantilevered beam being flexibly mounted on said first electrical connector;

said yoke of said connector position assurance device surrounding, engaging with and longitudinally sliding along said at least one cantilevered beam of said first electrical connector.

2. The apparatus of claim 1 further comprising:

a second electrical connector mateable with said first electrical connector, a locking member projecting from a body of said second electrical connector;

said at least one cantilevered beam having an abutting surface engageable with said locking member when said electrical connectors are fully mated; and said connector position assurance device positionable to secure said at least one cantilevered beam to said locking member.

3. The apparatus of claim 1 wherein said arm of said connector position assurance device is flexible in relation to said yoke.

4. An apparatus comprising:

a connector position assurance device having a yoke and an arm longitudinally extending from said yoke, an abutting member projecting from a surface of said arm, said yoke having a longitudinally oriented passageway therethrough;

at least one cantilevered beam being flexibly mounted on a first electrical connector;

said yoke of said connector position assurance device engaging with and longitudinally sliding along said at least one cantilevered beam of said first electrical connector;

a second electrical connector mateable with said first electrical connector, a locking member projecting from a body of said second electrical connector;

said at least one cantilevered beam having an abutting surface engageable with said locking member when said electrical connectors are fully mated;

said connector position assurance device positionable to secure said at least one cantilevered beam to said locking member;

said locking member including:

(a) a leading ramp;

(b) a trailing ramp joined to said leading ramp thereby defining a transversely oriented apex;

(c) a locking surface oriented in a substantially transverse manner and substantially perpendicular to a longitudinal axis through said second electrical connector, said locking surface juxtapositioned immediately adjacent to said trailing ramp; and (d) a V-shaped wedge pointing toward a trailing end of said second electrical connector and extending between an upper segment of said locking member and said body of said second electrical connector.

5. An apparatus comprising:

a connector position assurance device having a yoke and an arm longitudinally extending from said yoke, an abutting member projecting from a surface of said arm, said yoke having a longitudinally oriented passageway therethrough;

at least one cantilevered beam being flexibly mounted on a first electrical connector;

said yoke of said connector position assurance device engaging with and longitudinally sliding along said at least one cantilevered beam of said first electrical connector;

a second electrical connector mateable with said first electrical connector, a locking member projecting from a body of said second electrical connector;

said at least one cantilevered beam having an abutting surface engageable with said locking member when said electrical connectors are fully mated;

said connector position assurance device positionable to secure said at least one cantilevered beam to said locking member; and an upper segment of said locking member having a leading ramp with a leading undercut below said ramp;

said yoke of said connector position assurance device having an upper wall and a lower wall which are positionable to trap said at least one cantilevered beam and a portion of said upper segment of said locking member therebetween.

6. An apparatus comprising:

a connector position assurance device having a yoke with at least four walls and an arm longitudinally extending from said yoke, an abutting member projecting from a surface of said arm, said yoke having a longitudinally oriented passageway through said at least four walls;

a first electrical connector; and at least two cantilevered beams being flexibly mounted on said first electrical connector;

said yoke of said connector position assurance device surrounding, engaging with and longitudinally sliding along said at least two cantilevered beams of said first electrical connector, said at least two cantilevered beams extending substantially parallel to each other and to a longitudinal mating axis, said two cantilevered beams further having abutting formations against which said abutting member of said connector position assurance device is engagable.

7. The apparatus of claim 6 wherein walls of said yoke define an unbroken shape surrounding said passageway.

8. An electrical connector assembly comprising:

a connector position assurance device having a yoke with at least four walls with a longitudinally oriented passageway therethrough;

a first electrical connector having at least one cantilevered beam flexibly mounted thereon;

said yoke of said connector position assurance device positioned around said at least one cantilevered beam and engaging with said at least one cantilevered beam of said first electrical connector for longitudinally sliding therealong; and a second electrical connector having a locking member projecting from a body, said locking member having a leading undercut;

whereby a wall of said yoke is positionable into said undercut when said at least one cantilevered beam engages said locking member such that said yoke aids in securing said electrical connectors together.

9. The electrical connector assembly of claim 8 wherein said connector position assurance device further includes an arm flexibly joined to said yoke, an abutting member protruding from said arm for engagement with an abutting formation of said at least one cantilevered beam of said first electrical connector.

10. The electrical connector assembly of claim 8 wherein said wall of said yoke defines an unbroken shape surrounding said passageway.

11. The apparatus of claim 8 wherein said locking member includes:

a leading ramp;

a trailing ramp joined to said leading ramp thereby defining a transversely oriented apex;

a locking surface oriented in a substantially transverse manner and substantially perpendicular to a longitudinal axis through said second electrical connector, said locking surface juxtapositioned immediately adjacent to said trailing ramp; and a V-shaped wedge pointing toward a trailing end of said second electrical connector and extending between an upper segment of said locking member and said body of said second electrical connector.

12. The apparatus of claim 8 wherein said locking member includes:

an upper segment having a leading ramp with a leading undercut; and said yoke of said connector position assurance device having an upper wall and a lower wall which are positionable to trap said at least one cantilevered beam and a portion of said upper segment of said locking member.

13. The apparatus of claim 8 wherein said at least one cantilevered beam of said first electrical connector is further defined as two cantilevered beams extending substantially parallel to each other and to a longitudinal mating axis, said two cantilevered beams further have abutting formations against which said abutting member of said connector position assurance device is engagable.

14. A method for mating first and second electrical connectors together and for employing a connector position assurance device, said method comprising the steps of:

(a) engaging at least two cantilevered beams of said first electrical connector with a locking member of a second electrical connector;

(b) engaging said connector position assurance device with said locking member of said second electrical connector;

(c) surrounding a portion of said at least two cantilevered beams within a yoke of said connector position assurance device;

(d) aiding in securing said electrical connectors together by said connector position assurance device;

(e) depressing distal ends of said at least two cantilevered beams toward a body of said second electrical connector thereby disengaging an abutting formation of said at least two cantilevered beams from a locking surface of said locking member; and (f) flexing said at least two cantilevered beams transversely around said locking member upon disengaging of said first and second electrical connectors.

15. The method of claim 14 further comprising the steps of:

(a) flexing an arm of said connector position assurance device over said locking member of said second electrical connector; and (b) engaging an abutting member projecting from said arm of said connector position assurance device with an abutting formation of said at least two cantilevered beam of said first electrical connector upon full mating between said first and second electrical connectors.

16. The method of claim 14 further comprising the steps of:

(a) longitudinally sliding said connector position assurance device forward along said at least one cantilevered beam; and (b) aiding in said engaging of said at least one cantilevered beam with said locking member by said sliding of step (a).

* * * * *